US007073213B2

(12) United States Patent
Duarte et al.

(10) Patent No.: US 7,073,213 B2
(45) Date of Patent: Jul. 11, 2006

(54) UPRIGHT HINGE FOR SPA COVER

(76) Inventors: Carlos Duarte, 906 W. Donington St., Glendora, CA (US) 91741; Fred S. Romero, 19637 Golden Bough, Covina, CA (US) 91724

( * ) Notice: Subject to any disclaimer, the term of this patent is extended or adjusted under 35 U.S.C. 154(b) by 0 days.

(21) Appl. No.: 10/622,213

(22) Filed: Jul. 18, 2003

(65) Prior Publication Data

US 2005/0011001 A1 Jan. 20, 2005

(51) Int. Cl.
*E04H 4/00* (2006.01)

(52) U.S. Cl. ..... 4/498; 4/500; 220/264

(58) Field of Classification Search ..... 4/498, 4/500; 220/263, 264; 49/255; 411/30
See application file for complete search history.

(56) References Cited

U.S. PATENT DOCUMENTS

| | | | |
|---|---|---|---|
| 586,476 | A | 7/1897 | Coates |
| 1,068,391 | A | 7/1913 | Jensen |
| 1,115,345 | A | 10/1914 | Steuernagel |
| 1,115,465 | A | 10/1914 | Goddin |
| 2,376,966 | A | 5/1945 | Ingerman |
| 2,516,196 | A | 7/1950 | Fowler |
| 2,551,305 | A | 5/1951 | Tompkins |
| 2,590,028 | A | 3/1952 | Miller |
| 2,648,516 | A | 8/1953 | Manetti et al. |
| 2,689,101 | A | 9/1954 | Dygert |
| 2,793,387 | A | 5/1957 | Odell |
| 2,840,847 | A | 7/1958 | Danser |
| 2,853,352 | A | 9/1958 | Gittins |
| 3,001,225 | A | 9/1961 | Squire |
| 3,038,196 | A | 6/1962 | Nyquist |
| 3,261,051 | A | 7/1966 | Priest |
| 3,351,975 | A | 11/1967 | Goto |
| 3,539,239 | A | 11/1970 | Mallonn |

(Continued)

FOREIGN PATENT DOCUMENTS

| | | |
|---|---|---|
| FR | 2089842 | 1/1972 |

(Continued)

OTHER PUBLICATIONS

The Ideal Lift with Installation Instruction for the Ideal Cover Lift; http://www.rhtubs.com/coverlifts/ideal-lift.htm and http://www.rhtubs.com/coverlifts/ideal-lift-instructions.htm; 7 pages.

(Continued)

*Primary Examiner*—Khoa D. Huynh
(74) *Attorney, Agent, or Firm*—Christie, Parker & Hale, LLP.

(57) ABSTRACT

A hinge assembly for coupling a spa cover to a spa includes a mounting bracket disposed near a top of the spa, a support arm which is pivotably coupled to the mounting bracket about an axis of rotation, and a spring member disposed between the mounting bracket and the support arm. The spa cover is movable between a fully closed position and a fully open position. The support arm is attached on an outside surface of the spa cover at a vertical offset from the axis of rotation when the spa cover is in the fully closed position. The spring member, which may be a gas spring, forms an angle of less than approximately 45 degrees with respect to the top of the spa when the spa cover is in the fully open position. A metal plate may be affixed using a double sided tape on an outside surface of the spa cover, and then anchored to the spa cover. The metal plate may be used to attach the support arm to the spa cover.

25 Claims, 9 Drawing Sheets

U.S. PATENT DOCUMENTS

| | | | | |
|---|---|---|---|---|
| 4,076,203 | A | 2/1978 | McDonnell | |
| 4,167,298 | A | 9/1979 | Plattner | |
| 4,215,885 | A * | 8/1980 | McCray | 292/338 |
| 4,223,420 | A | 9/1980 | Yukimoto et al. | |
| 4,383,721 | A | 5/1983 | Knaack et al. | |
| D278,010 | S | 3/1985 | Ostrander | |
| 4,853,985 | A | 8/1989 | Perry | |
| 4,857,374 | A | 8/1989 | Perry | |
| 4,893,863 | A | 1/1990 | Skonieczny et al. | |
| 4,899,420 | A | 2/1990 | Bye et al. | |
| 4,953,259 | A | 9/1990 | Frye et al. | |
| 4,953,985 | A | 9/1990 | Miller | |
| 4,966,403 | A | 10/1990 | Nordström | |
| 4,991,238 | A | 2/1991 | Forrest | |
| 5,027,473 | A | 7/1991 | Hottmann | |
| 5,048,153 | A | 9/1991 | Wall et al. | |
| 5,050,943 | A | 9/1991 | Barnett | |
| 5,131,102 | A | 7/1992 | Salley et al. | |
| 5,172,969 | A | 12/1992 | Reuter et al. | |
| 5,409,308 | A | 4/1995 | Reuter et al. | |
| 5,471,685 | A | 12/1995 | Cross | |
| 5,517,703 | A | 5/1996 | Ouelette | |
| 5,566,403 | A | 10/1996 | Black et al. | |
| 5,584,081 | A | 12/1996 | Ouelette | |
| 5,634,218 | A | 6/1997 | Ouelette | |
| 5,644,803 | A | 7/1997 | Wilson | |
| 5,689,841 | A | 11/1997 | Black et al. | |
| 5,692,864 | A * | 12/1997 | Powell et al. | 411/30 |
| 5,819,332 | A | 10/1998 | Perry | |
| 5,847,374 | A | 12/1998 | Menconi | |
| 5,896,619 | A | 4/1999 | Koopman | |
| 5,904,411 | A | 5/1999 | Hayakawa | |
| 5,950,252 | A | 9/1999 | Fettes | |
| 5,974,599 | A | 11/1999 | Tudor | |
| 5,974,600 | A | 11/1999 | Pucci et al. | |
| 5,996,137 | A | 12/1999 | Genova | |
| 6,000,071 | A | 12/1999 | Fettes | |
| 6,000,072 | A | 12/1999 | LaHay | |
| 6,032,305 | A | 3/2000 | Tedrick | |
| 6,105,529 | A * | 8/2000 | Kyle | 114/201 R |
| 6,158,063 | A | 12/2000 | Tudor | |
| 6,195,811 | B1 | 3/2001 | Dragovic | |
| 6,381,766 | B1 | 5/2002 | Perry | |
| 6,393,630 | B1 | 5/2002 | Tedrick | |
| 6,442,799 | B1 | 9/2002 | Duarte et al. | |
| 6,795,984 | B1 * | 9/2004 | Brady | 4/498 |
| 2002/0050003 | A1 | 5/2002 | Perry | |

FOREIGN PATENT DOCUMENTS

| | | |
|---|---|---|
| FR | 2091715 | 1/1972 |

OTHER PUBLICATIONS

The Cover Valet with Installation Instructions for the Cover Valet; http://www.rhtubs.com/coverlifts/cover-valet.htm and http://www.rhtubs.com/coverlifts/cover-valet-instructions.htm; 6 Pages.

Ideal E-Z Lifter with Installation Instructions for the E-Z Lifter; http://www.rhtubs.com/coverlifts/EZlifter.htm and http://www.rhtubs.com/coverlifts/EZlifter-instructions.htm; 9 Pages.

Covermate I and Installation Instructions for the Covermate I; http://www.rhtubs.com/coverlifts/cover-mate1.htm and http://www.rhtubs.com/coverlifts/covermate1-%20instructions.htm; 7 Pages.

Covermate II with Installation Instructions for the Covermate II; http://www.rhtubs.com/coverlifts/covermate2.htm and http://www.rhtubs.com/coverlifts/covermate2-instructions.htm; 10 Pages.

Covermate III with Installation Instructions for the Covermate III; http://www.rhtubs.com/coverlifts/covermate3.htm and http://www.rhtubs.com/coverlifts/covermate3-instructions.htm; 7 Pages.

HotSpring Portable Spas, Virtual Showroom, http://www.hotspring.com/Virtual/accessories.html, http://www.hotspring.com/Virtual/jpgs/gliderite_full.jpg, http://www.hotspring.com/Built/jpgs/reg_cover_closed.jpg, and http://www.hotspring.com/Virtual/jpgs/uprite.jpg, 5 Pages.

Franz, Hettich K.G., Germany, The Complete Häfele, Swing-Up Fittings, Jul. 1998, pp. 5.30-5.31.s.

Sanderfoot, Alan E, Rising to the Occasion, AQUA Magazine, Jun. 1996.

Tubcap by CEnTech Corporation (8 pages).

* cited by examiner 100
101
103
112
113
114
118
122
136
138
140
142
144
146
148
150

111
147
145
141
123
127
139
157
115
155
137
125
159

UPRIGHT HINGE FOR SPA COVER

CROSS-REFERENCE TO RELATED APPLICATION(S)

This application includes subject matter related to U.S. patent application Ser. No. 10/622,198 filed on Jul. 18, 2003, the contents of which are incorporated by reference herein.

FIELD OF THE INVENTION

This application is related to a hinge between a spa and a spa cover, and more particularly, to a hinge that allows a spa cover to be stowed in an upright position when the spa is open.

BACKGROUND

Commercially available spas typically have a spa cover to prevent dirt or dust from entering therein. To open the spa, a spa cover is typically folded in half, hingedly lifted off the top of the spa, and lowered vertically behind the spa so as to reduce its obstruction of view to a person using the spa. However, such lowering and stowage of the spa cover typically requires an area behind the spa that may be larger than available in a small backyard.

To accommodate those without sufficient room to stow the spa cover behind the spa, some spa covers are kept in an upright position when the spa is fully open. This way, less room is typically required behind the spa. However, spa covers in an upright position are more susceptible to a gust of wind that blows against it from the rear or other forces that tend to close the spa cover when an occupant is in the spa.

U.S. Patent Publication No. 2002/0050003 filed by Perry ("Perry I") discloses a gas spring lock for engaging and locking a gas spring in the extended position so that covers of spas, hot tubs and other similar apparatus that employ gas springs can be safely locked into an open position.

U.S. Pat. No. 6,000,071 issued to Fettes ("Fettes I") discloses an apparatus for aiding removal and replacement of a spa cover. Fettes I discloses a lifting system for exerting a lifting force on an arm attached to the spa cover, tending to lift the arm as the arm moves from the covering position toward the uncovering position, and for exerting a resistance force on the arm tending to resist movement of the arm from the uncovering position toward the covering position.

U.S. Pat. No. 5,950,252 issued to Fettes ("Fettes II") discloses a device for aiding in the removal and replacement of a spa cover atop a spa tub. FIGS. 11–13 disclose a spa cover that is stowed at an upright position.

U.S. Pat. No. 5,689,841 issued to Black et al. ("Black et al.") discloses a spa cover lifting apparatus which can be adjusted to accommodate spa covers of different sizes. The lifting action of the apparatus is assisted by a telescoping gas strut.

In each of the above publication and patents, a gas spring forms an angle that is more than 45 degrees with respect to the top of the spa when the spa cover is in a fully open position.

U.S. Pat. No. 5,819,332 issued to Perry ("Perry II") discloses a spa cover removal apparatus. As seen in FIG. 8, the gas spring 63 can assume an infinite number of positions thereby providing a wide range of adjustment for the amount of load it assumes to resist.

U.S. Pat. No. 4,899,420 issued to Bye et al. ("Bye et al.") discloses a hinge system for a large or heavy cover member hinged to a container member. A container hinge plate is secured to a side wall of the container member. A cover hinge plate is secured to a side wall of the cover member and rotatably connected to the first hinge means at a hinge pivot means. Bye et al. also discloses a gas strut that appears to form an angle that is less than 45 degrees with respect to a horizontal plane. The cover member pivots with respect to the container member about the same axis as the axis of rotation between the container hinge plate and the cover hinge plate.

U.S. Pat. No. 6,195,811 issued to Dragovic ("Dragovic") discloses a spa cover mounting method and apparatus. Dragovic discloses that a foam spa cover member is attached to a cover lifter apparatus using a plurality of brackets.

SUMMARY

In an exemplary embodiment according to aspects of the present invention, a hinge assembly for coupling a spa cover to a spa is provided. The spa cover is movable between a fully closed position and a fully open position. The hinge assembly includes: a mounting bracket disposed near a top of the spa; a support arm which is pivotably coupled to the mounting bracket about an axis of rotation, and attached on an outside surface of the spa cover at a vertical offset from the axis of rotation when the spa cover is in the fully closed position; and a spring member disposed between the mounting bracket and the support arm. The spring member forms an angle of less than approximately 45 degrees with respect to the top of the spa when the spa cover is in the fully open position.

In another exemplary embodiment according to aspects of the present invention, a spa system is provided. The spa system includes a spa; a foldable spa cover having at least two sections, and a hinge assembly for coupling the spa cover to the spa. The spa cover is movable between a fully closed position and a fully open position. The hinge assembly includes: a mounting bracket disposed near a top of the spa; a support arm which is pivotably coupled to the mounting bracket about an axis of rotation, and attached on an outside surface of the spa cover at a vertical offset from the axis of rotation when the spa cover is in the fully closed position; and a spring member disposed between the mounting bracket and the support arm. The spring member forms an angle of less than approximately 45 degrees with respect to the top of the spa when the spa cover is in the fully open position.

In yet another exemplary embodiment according to the aspects of the present invention, a method of mounting a hinge mechanism between a spa and a spa cover having a core and a cover is provided. The method includes: affixing at least one metal plate on an external surface of the cover using an adhesive, said at least one metal plate having a hole; and inserting a screw and an anchor engaging the screw through the hole on said at least one metal plate into the spa cover, wherein said adhesive can provide sealing to the cover.

These and other aspects of the invention will be more readily comprehended in view of the discussion herein and accompanying drawings, in which like reference numerals designate like elements.

DETAILED DESCRIPTION

Figure 1:
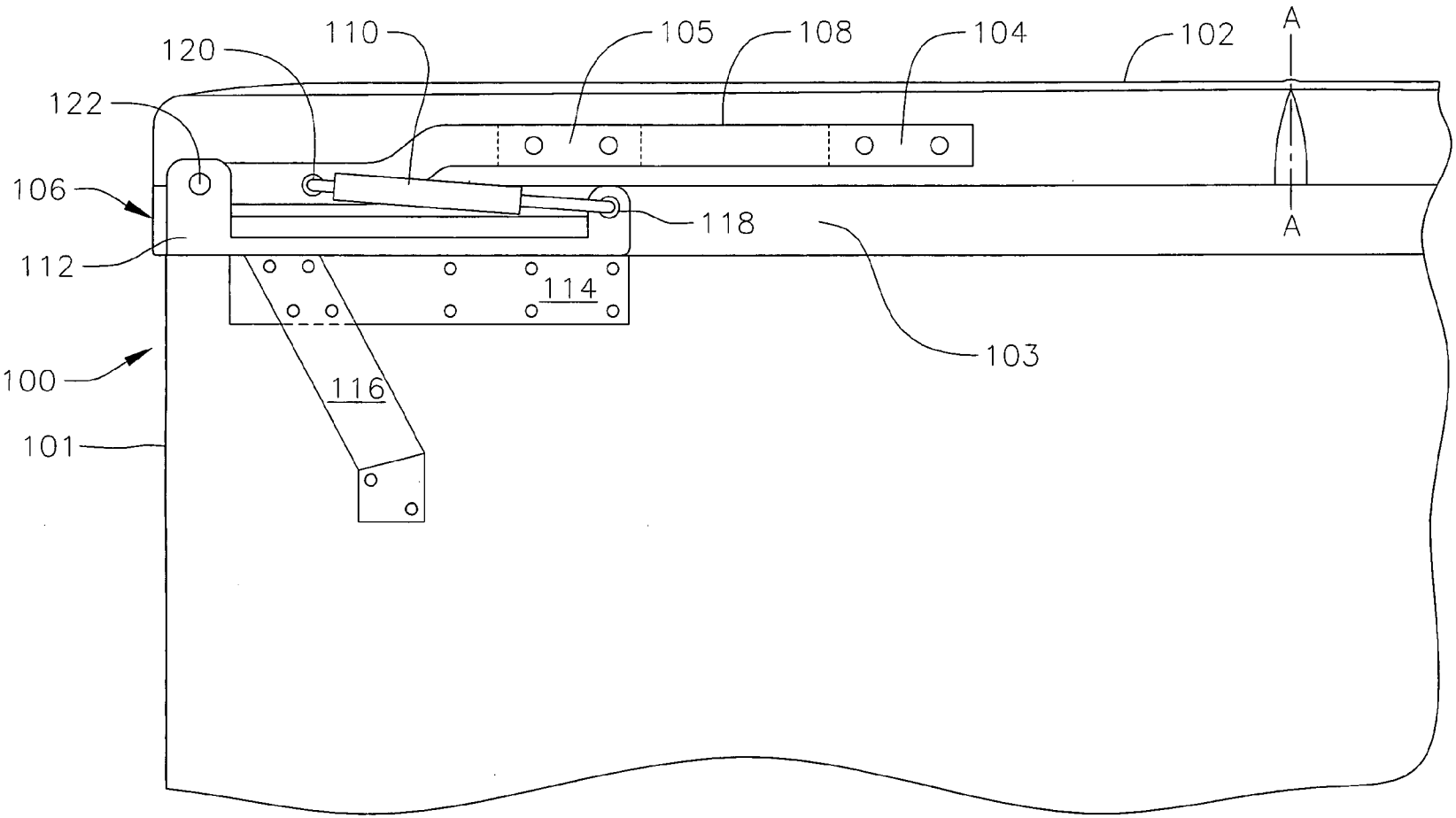
FIG. 1 is a side view of a hinge assembly (in a closed position) that couples a spa cover to a spa in an exemplary embodiment according to aspects of the present invention.

FIG. 1 is a side view of a hinge assembly 106 that couples a spa cover 102 to a spa 100 in an exemplary embodiment according to aspects of the present invention. The spa 100 includes an outer wood frame 101 surrounding an inner spa 103. The inner spa 103, for example, may be fabricated using fiberglass.

In FIG. 1, the spa is in a closed position, where the spa cover 102 completely covers the opening of the spa. The spa cover is foldable at a fold line A—A into two substantially rectangular sections that are approximately equal in size. When opening the spa, the spa cover is first folded into two sections, one on top of the other, and then the folded spa cover is rotated about the rear edge at the top of the spa to completely open the spa.

The hinge assembly 106 is mounted near the rear edge and on the outer wooden frame 101 of the spa when viewed from the left side of the spa. There is provided another hinge assembly on the right side of the spa 100, which is hidden from view in FIG. 1. The right side hinge assembly has substantially the same configuration as the hinge assembly 106, except that the right side hinge assembly when viewed from the right side is a mirror image of the hinge assembly 106. Therefore, the hinge assembly will be described in reference to the left side hinge assembly 106 with an understanding that the right and left side hinge assemblies have substantially the same configuration (but with a mirror image) as each other.

Figure 2:
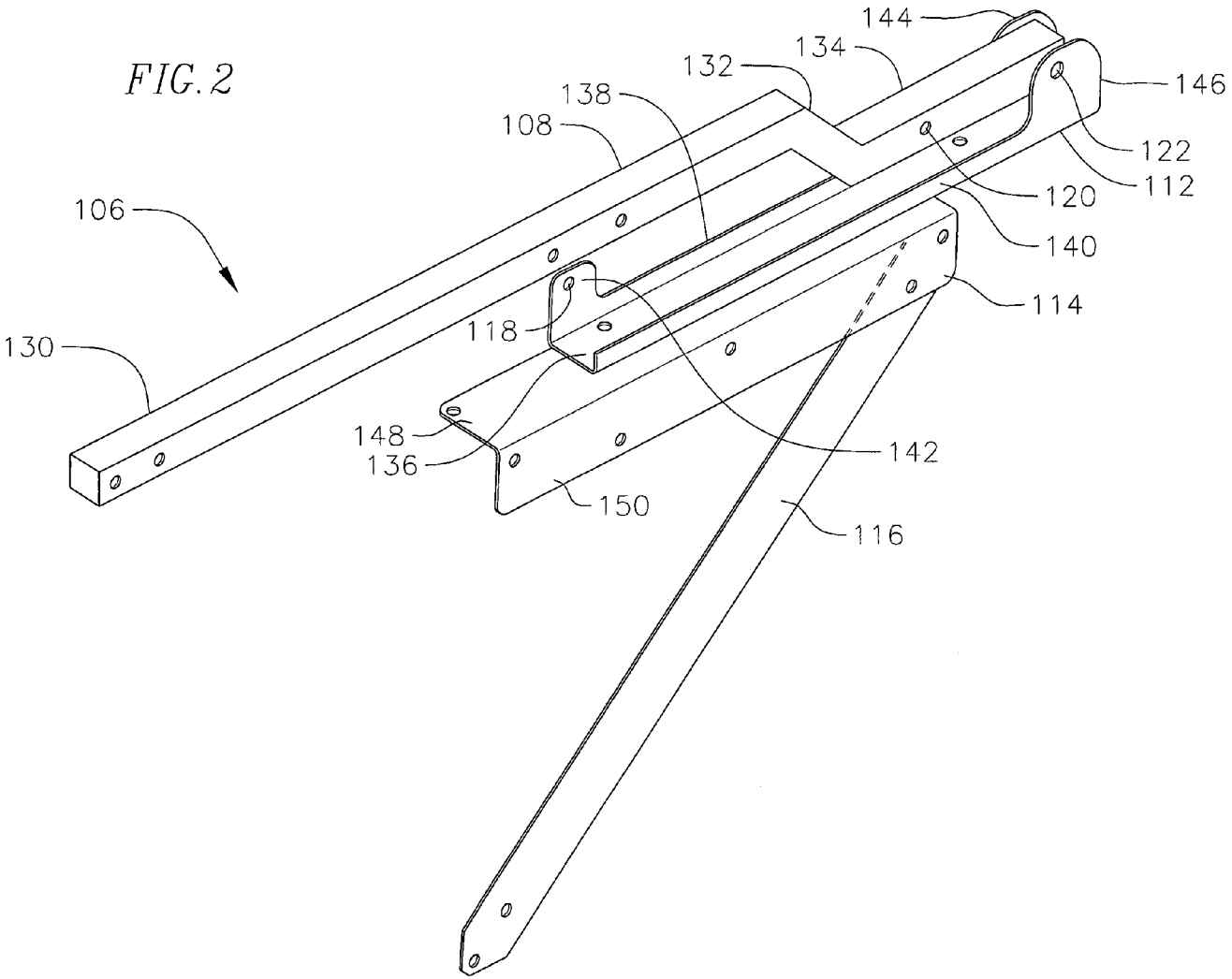
FIG. 2 is a perspective view of the hinge assembly coupled to a side mount support bracket and a brace of FIG. 1.

With reference also to FIG. 2, the hinge assembly 106 includes a support arm 108, a mounting bracket 112 and a spring member 110. The spring member may help with the lifting of the spa cover 102. Further, the spring member may provide resistance against closing of the spa cover 102. The spring member 110, for example, may be a gas spring. It should be noted that the spring member 110 is mounted outside the spa, and not inside. The hinge assembly is mounted on the spa using a side mount support bracket 114 and a brace 116 that are fixedly mounted on the left side of the spa (i.e., outer wooden frame 101).

The spring member 110 is pivotably coupled to a pivot 118 on an end (i.e., the end away from the rear edge of the spa) of the mounting bracket 112 and a pivot 120 on the support arm 108. In the exemplary embodiment, the location of the pivot 120 on the support arm 108 is fixed. The resistance provided by the spring member 110 can be adjusted, for example, by replacing it with stronger or weaker spring members (e.g., gas springs).

The angle the spring member 110 forms with respect to the top of the spa when the spa is fully open is fixed at approximately 15 degrees in the described exemplary embodiment. In other exemplary embodiments, however, the angle between the spring member 110 and the top of the spa may be different. For example, the angle the spring member 110 forms with respect to the top of the spa when the spa is fully open may be approximately 45 degrees, less than 40 degrees, less than 30 degrees, less than 20 degrees or less than 15 degrees in various different embodiments. In alternate embodiments, the location of the pivot 120 may be adjusted on the support arm 108 so as to change the resistance provided by the spring member.

The support arm 108 has an elongated arm section 130, a short arm section 134 and a connecting member 132 disposed between the elongated arm section 130 and the short arm section 134. The connecting member 132 forms an angle with respect to the elongated arm section and also with respect to the short arm section. This way, the spa cover 102 attached to the elongated arm section 130 can be lifted up slightly and away from the spa as the support arm 108 is rotated with respect to the mounting bracket 112 about the pivot 122 to place the spa cover in a fully open position. In other words, the support arm 108 is shaped to enable the spa cover to be lifted up from the top of the spa and not aligned with an axis of rotation as the support arm is pivotably rotated with respect to the mounting bracket 112 to place the spa cover in a fully open position. Otherwise, the spa cover 102 may jamb against the top of the spa during the opening process.

The elongated arm section 130 has two holes formed thereon at the end away from the connecting member 132. These holes may be used to attach the elongated arm section 130 to the spa cover as will be described later. The elongated arm section 130 also has two holes formed thereon about two-thirds of the way between the end having two holes and the connecting member 132. These holes may also be used to attach the elongated arm section 130 to the spa cover as will be described later.

The short arm section 134 has formed thereon a hole for coupling the spring member thereto to form the pivot 120. In alternate embodiments, the location of the pivot 120 and therefore the hole for the same may be moved to adjust the resistance provided by the spring member against closing of the spa cover as described above. Each of the arm sections and the connecting member has a substantially rectangular cross-section in the exemplary embodiment.

Figure 3:
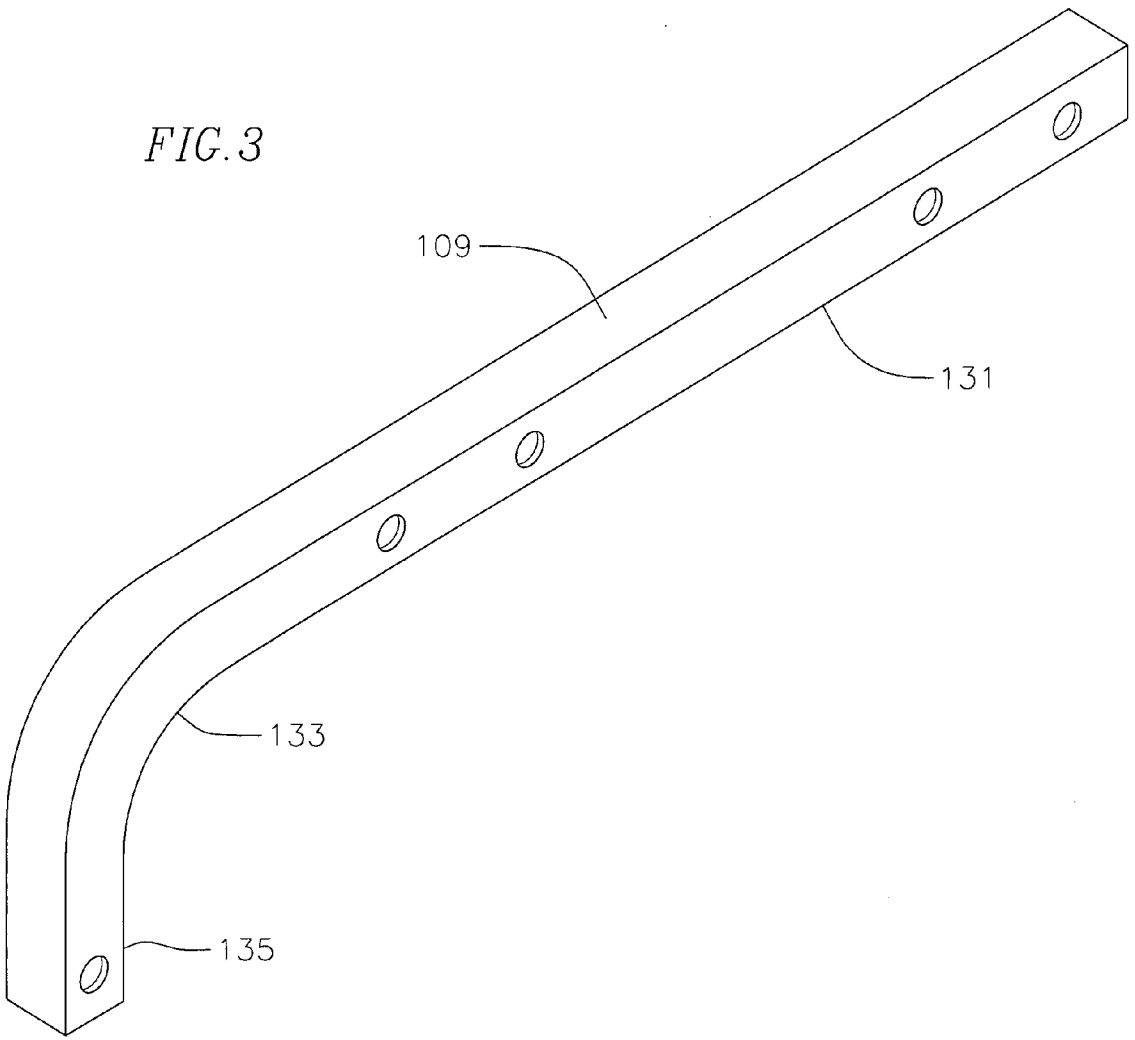
FIG. 3 is a perspective view of a support arm in an alternate embodiment.

The support arm 108 may have other configurations in other embodiments. For example, the arm sections and the connecting member may have cross-sections that are different from a rectangular cross-section. Further, in an alternate embodiment as depicted in FIG. 3, a support arm 109 may include an elongated arm section 131 connected to a short arm section 135 through a connecting member 133 that has a curvature. In the alternate embodiment of FIG. 3, the short arm section 135 may be pivotably connected to a mounting bracket to form a pivot while the elongated arm section 131 is attached along the side of one of the two foldable spa cover sections. Due to the curvature of the connecting member 133, a spa cover attached to the elongated arm section 131 can be lifted up slightly and away from the spa as the support arm 109 is rotated with respect to a mounting bracket about a pivot to place the spa cover in a fully open position. Otherwise, the spa cover may jamb against the top of the spa during the opening process.

Returning now to FIGS. 1 and 2, the mounting bracket 112 includes a web 136 that has a shape of an elongated rectangle. The web 136 has attached thereon substantially vertical lips 138 and 140 that run substantially in parallel along the side of the web 136 through substantially the whole length of the web 136. The lips 138 and 140 also have a substantially elongated rectangular shape.

The lip 138 has formed thereon semi-elliptical protrusions 142 and 144, respectively, on its ends. The semi-elliptical protrusion 142 has formed thereon a hole for forming the pivot 118 between the spring member 110 and the mounting bracket 112. The other lip 140 has formed thereon only one semi-elliptical protrusion 146 that faces the semi-elliptical protrusion 144 on the lip 138. The protrusion 146 has formed thereon a hole for forming the pivot 122 between the mounting bracket 112 and the support arm 108, and the protrusion 144 also has formed thereon a hole (not shown) for forming the pivot 122 together with the hole on the protrusion 146.

The web 136 of the mounting bracket 112 is mounted on top of and attached to the side mount support bracket 114. The side mount support bracket 114 is L-shaped having a substantially rectangular horizontal member 148 and a substantially rectangular vertical member 150. The horizontal member 148 may have formed thereon one or more holes for mounting the mounting bracket 112 on the horizontal member 148. The mounting bracket 112 may also have holes that match the holes on the horizontal member 148. The vertical member 150 may have formed thereon one or more holes for fastening the side mount support bracket on the side of the outer wooden frame 101 near the rear edge and close to the top of the spa.

Figures 4A, 4B:
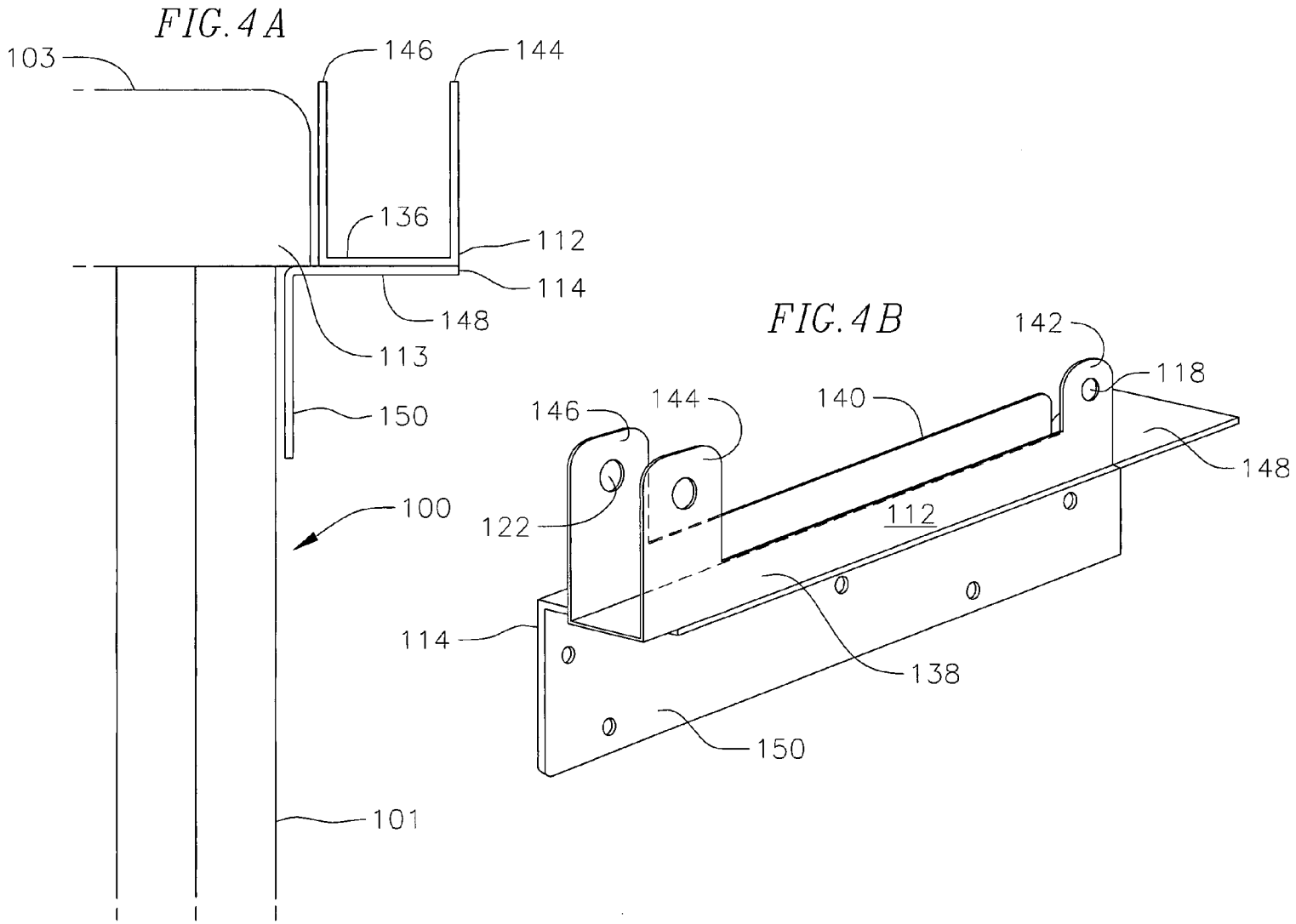
FIG. 4A is a view of the side mount support bracket and the mounting bracket as seen from behind the spa.
FIG. 4B is a perspective view of the mounting bracket of FIG. 1 mounted on top of the side mount support bracket.

The installation of the side mount support bracket 114 and the mounting bracket 112 on the outer wooden frame 101 may best be described in reference to FIGS. 4A and 4B. It can be seen that the inner spa 103 has a lip portion 113 at the top that protrudes over and out of the outer wooden frame 101. The vertical member 150 is installed on the outer wooden frame right below the lip portion 113, where the top surface of a portion of the horizontal member 148 abuts the underside of the lip portion 113. A major portion of the horizontal member 148 is not under the lip portion 113, and the mounting bracket 112 is mounted on this major portion of the horizontal member 148.

As can be seen in FIGS. 2 and 4B, the mounting bracket 112 is not mounted through its entire length on the horizontal member 148 of the side mount support bracket 114. Instead, an end portion where the pivot 122 is located protrudes over and out of the edge of the horizontal member 148. Further, the edge of the mounting bracket 112 on the side where the pivot 118 is located does not extend all the way to the edge of the horizontal member 148.

Returning now to FIGS. 1 and 2, the brace 116 has a substantially elongated rectangular shape. In one embodiment, the ends may be rectangular. In other embodiments, one or both ends may taper so as to form a substantially triangular or trapezoidal shape at one or both ends. The brace 116 is attached on the vertical member 150 at one end thereof at an angle such that the end of the brace 116 away from the attachment location with the vertical member 150 points downward and toward the front of the spa. The downward pointing end of the brace 116 is attached to the outer wooden frame 101 so as to provide a structural support to the side mount support bracket 114.

Figure 5:
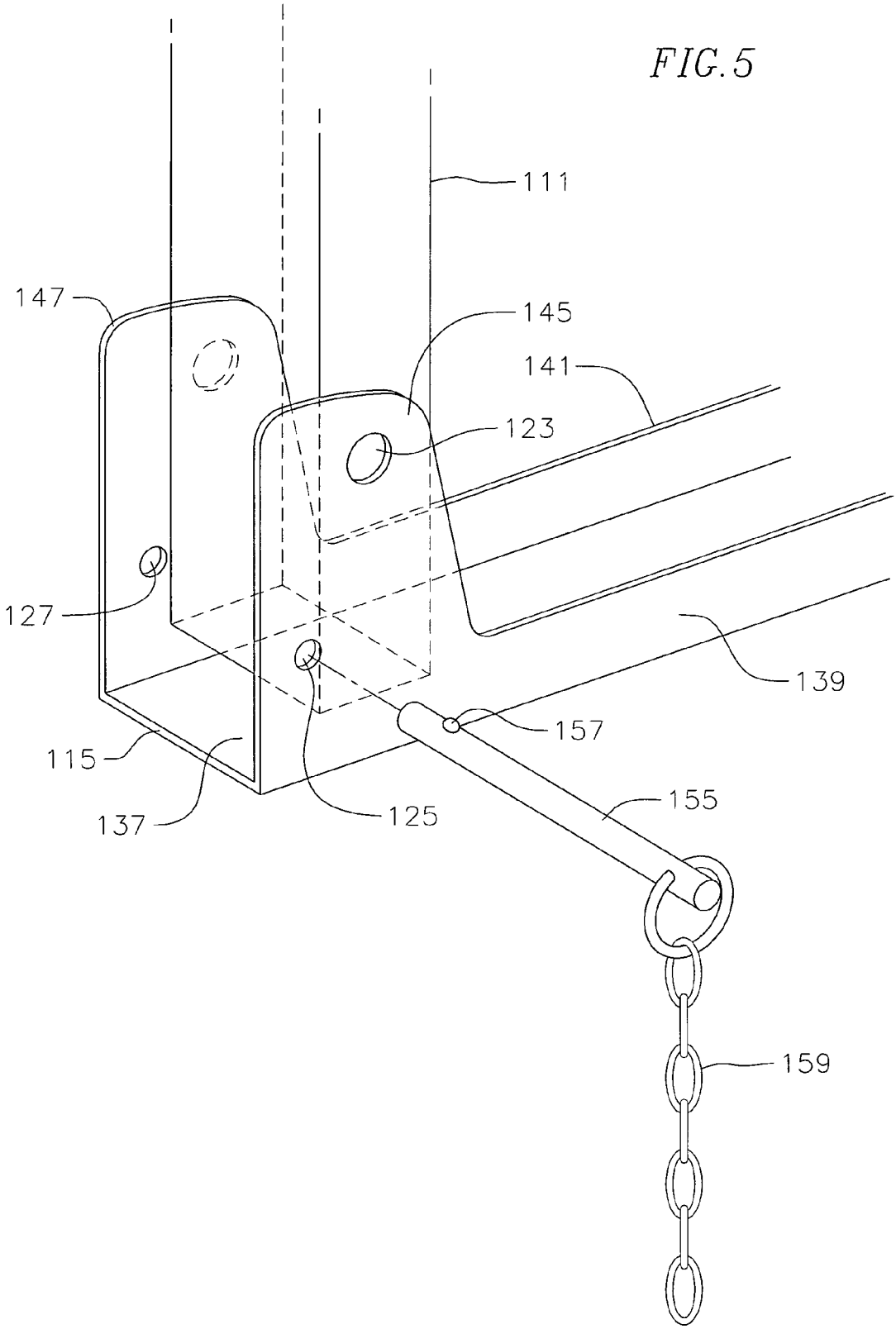
FIG. 5 is a perspective view that illustrates a locking mechanism between a support arm and a mounting bracket in an alternate embodiment.

In other embodiments as illustrated, for example, in FIG. 5, a hinge assembly may include a locking mechanism to hold the spa cover 102 in an upright position. In the embodiment of FIG. 5, a support arm 111 is hingedly coupled to a mounting bracket 115 about a pivot 123. The mounting bracket has lips 139 and 141 coupled through the whole length of a web 137, and formed thereon protrusions 145 and 147 that face each other, and on which respective holes for forming the pivot 123 have been formed.

The protrusions 145 and 147 also have formed thereon, respectively, two holes 125 and 127 for installing a safety lock pin 155. The safety lock pin 155 has formed thereon a locking ball for holding the pin 155 in place once it is installed through the holes 125, 127, and a chain 159 for attaching it to a stationary object so that the safety lock pin does not get lost. When the support arm 111 is in an open position and the safety lock pin 155 is installed (i.e., the locking mechanism has been engaged), the support arm 111 does not rotate with respect to the mounting bracket 112 because the safety lock pin 155 engages an end of the support arm, and physically prevents it from rotating towards a closed position.

Returning now to FIG. 1, the support arm 108 is fixedly attached to the spa cover 102 at two locations along the length of the spa cover. Both the attachment locations are on only one of the two spa cover sections (e.g., on the spa cover section that is under the other spa cover section when the spa cover is folded) so that the support arm need not be folded in a similar manner when folding the spa cover in two. At each attachment location, two parallel bolts or screws are used to fasten the support arm to the spa cover. In other embodiments, the support arm may be attached at more than two attachment locations on the spa cover section. Further, more or less than two bolts or screws may be used at each attachment location in other embodiments.

To support the attachment of the support arm 108 to the spa cover 102 at two attachment locations, two metal plates 104 and 105 are first mounted on the spa cover 102. In FIG. 1, the metal plates 104 and 105 are shown as rectangles having dotted lines along the left side edge of one of the spa cover sections. They are shown in dotted lines because they are at least partly hidden from view behind the support arm 108.

The metal plates 104 and 105 have a width that is substantially the same as the width of the support arm 108. In other embodiments, the width of the metal plates may be more or less than the width of the support arm 108. Further, a different size and/or number of metal plates (e.g., one long metal plate that runs along the length of one of the sections of the spa cover 102) may be used. A detailed description of installation and operation of the metal plates 104 and 105 is provided below in reference to FIGS. 6 and 7.

Figure 6:
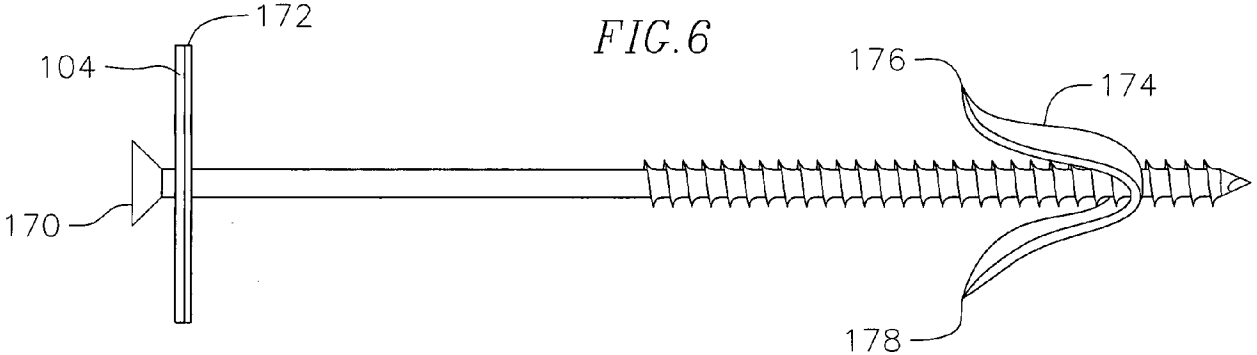
FIG. 6 is a side view of a metal plate assembly in an exemplary embodiment in accordance with aspects of the present invention.

FIG. 6 illustrates a side view of a metal plate assembly in an exemplary embodiment in accordance with aspects of the present invention. The metal plate assembly includes the metal plate 104, a double sided tape 172, a screw 170 and an anchor 174. It should be noted that while the metal plate assembly is described in reference to metal plate 104 of FIG. 1, the metal plate 105 (and any other metal plates used) may have substantially the same configuration. For example, when an angle formed of two adjoining plates is used, one of the plates may be inserted into the spa cover and/or its core. A slit may be preformed on the spa cover and/or the core to accommodate the insertion of that plate of the angle.

The metal plate 104 may be formed from aluminum and may have a rectangular shape and size varying, for example, between approximately 1"×4" (2.54 cm×10.16 cm) and approximately 1.75"×2" (4.445 cm×5.08 cm). The metal plate may have other dimensions in other embodiments. Further, the metal plate may have any other suitable shape such as angle, channel and the like.

The double sided tape 172 may cover one side of the metal plate 104 completely, and is affixed to the metal plate. The adhesive on the side away from the metal plate should remain covered until the metal plate (and the double sided tape) is ready to be affixed to a spa cover. The double sided tape 172 may, for example, be a 0.030 heavy duty doubled sided tape.

The screw 170, for example, may be a flat head Phillips drive drywall screw or any other suitable screw. The screw 170 may, for example, have a length of approximately 6" (15.24 cm), and may be coarsely threaded.

The anchor 174 is formed from an elongated metal strip that is approximately 2.5" (6.35 cm) in length. The anchor 174 is bent about its middle to form an elongated "U" shape. The anchor 174 has a hole about its middle that can be used to engage the thread on the screw 170. Hence, the anchor 174 may be described as an U-shaped member having a base with hole and two elongated wings. The anchor 174 has a pointed tip at both ends 176 and 178 (e.g., of the two wings), so that the wings can penetrate the material into which the anchor is embedded. The anchor may have other suitable shapes in other embodiments. The anchor 174 is deformable so that it can at least partly be unbent during the installation process.

Figure 7:
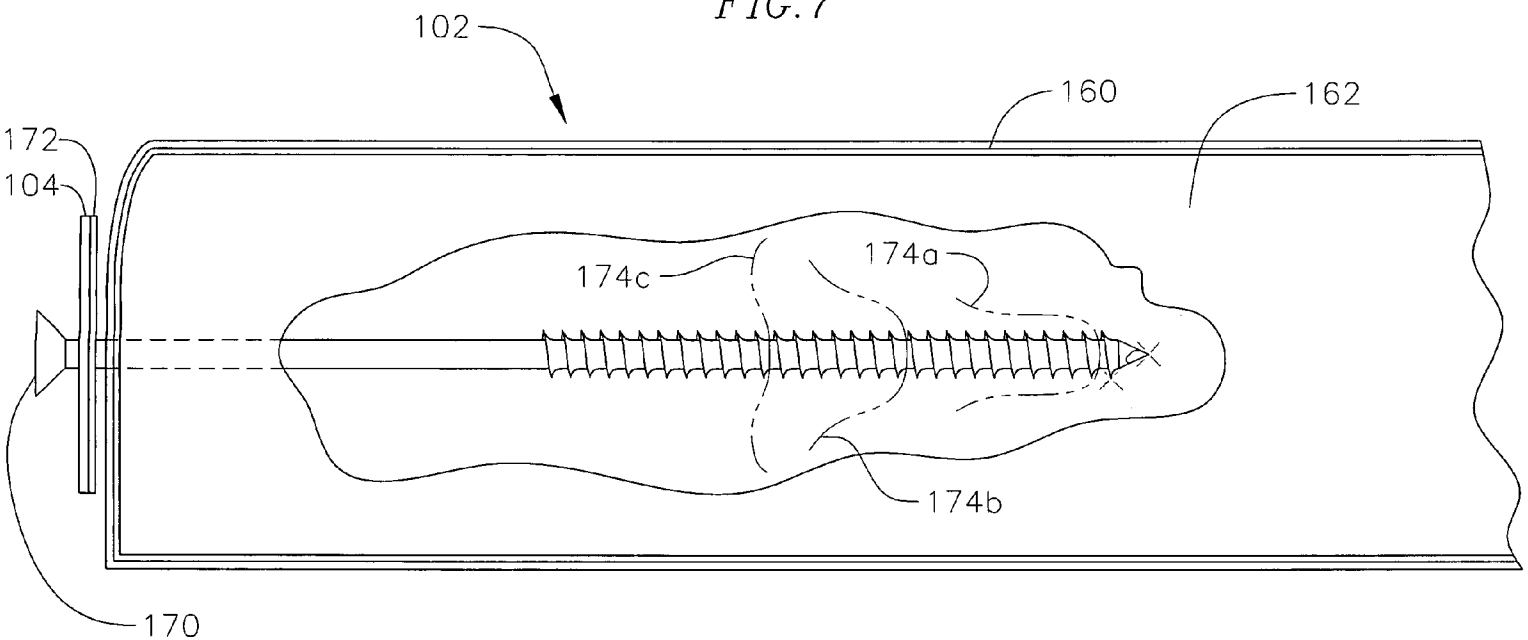
FIG. 7 illustrates the metal plate assembly of FIG. 6 being mounted on a spa cover.

FIG. 7 illustrates the metal plate assembly of FIG. 6 being mounted on a spa cover 102. The spa cover 102 has a core 162 (which may be formed from a solid block of foam) covered by a cover 160 (which may be formed from vinyl). In other embodiments, other suitable materials other than foam and/or vinyl may be used to fabricate the core and/or the cover, respectively It should be noted that while the installation of the metal plate assembly is described in reference to metal plate 104 of FIG. 1, the metal plate 105 (and any other metal plates used) may be installed in substantially the same manner.

During installation, the sticky portion not affixed to the metal plate of the double sided tape 172 should first be exposed so that the double sided tape 172, and therefore the metal plate 104, can be affixed on the cover 160. Then, the screw 170 is nailed (i.e., pounded in and not screwed) through a hole on the metal plate 104 and the cover 160 into the core 162 without removing the cover 160. This way, the steps of removing the cover and then reinserting the core into the cover may be avoided. In other embodiments, however, the cover may be removed to install the metal plates directly on the core. Since the anchor 174 engages the thread of the screw 170, the anchor is inserted into the core 162 together with the screw 170.

The metal plate may be affixed to the cover 160 via the double sided tape 172 at any time before, during or after nailing the screw 170 into the core 162. The adhesive on the double sided tape 172 may form a seal around the opening on the cover 160 formed by driving in the screw 170 so as to prevent moisture from entering inside the cover 160.

With the metal plate and the screw (and the anchor) in place, the screw is rotated to attach it firmly to the core 162. That is, at the time of inserting the screw into the core 162, the anchor 174 has an outline and relative location similar to that of a dotted outline 174*a*. As the screw is rotated, the anchor 174 travels towards the head of the screw 170 since the hole at the center of the anchor is engaging the thread of the screw 170. Moving towards the screw head, the anchor 174 is deformed since its movement is resisted by the core 162, which may be a solid block of foam material. Hence, during the process, the anchor has an outline and relative position 174*b*, for example, where the anchor has partially unbent wings due to the resistance provided by the core 162. As can be imagined, it would be harder and harder to turn the screw 170 since the resistance provided by the core 162 increases. Finally, the anchor may have an outline and relative position 174*c* when the screw is finally firmly anchored within the core 162, and the wings of the anchor 174 are further spread out.

Figure 8:
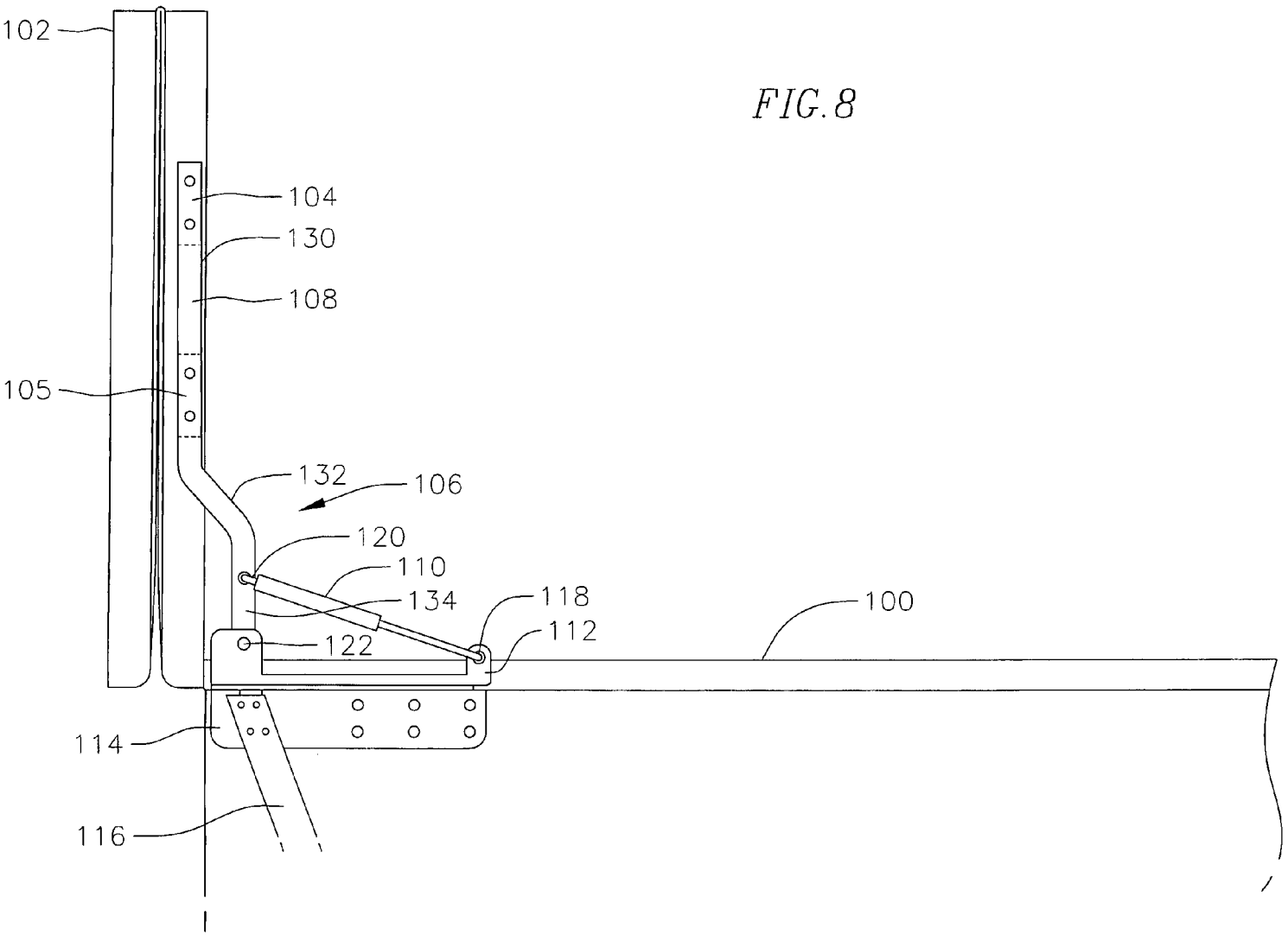
FIG. 8 is a side view of the hinge assembly (in an open position), spa cover and spa of FIG. 1.

FIG. 8 is a side view of the hinge assembly 106, spa cover 102 and spa 100 of FIG. 1, where the spa is in an open position. It can be seen that the spa cover 102 forms an approximately 90 degree angle with respect to the top of the spa. Further, the spa cover 102 is in an upright position, where it is not vertically moved downward (e.g., behind the spa) to reach a fully open position. The short arm section 134 of the support arm also forms an approximately 90 degree angle with respect to the top of the spa 100. This way, the requirement for room or space behind the spa 100 may be reduced, as compared to a spa whose cover is stowed behind the spa.

The spring member 110 (e.g., a gas spring) is in a fully extended position when the spa is fully open. It can be seen that the spring member forms an angle of approximately 15 degrees with respect to the top of the spa so that the spring member 110 provides a resistance against the gust of wind blowing from behind the spa cover or other forces that tend to close the spa cover in the upright position. In alternate embodiments, by adjusting the location of the pivot 120 on the short arm section 134, the resistance in the horizontal direction provided by the spring member 110 may be adjusted.

The support arm 108 is pivotably coupled to the mounting bracket 112 at a pivot 122. As can be seen from FIGS. 1 and 8, the pivot 122 is not aligned with the rear edge of the spa 100 nor is the pivot attached to the spa cover 102. This way, the spa cover 102 is not placed over the axis of rotation about the pivot 122 between the support arm 108 and the mounting bracket 112 when the spa cover is in a fully open position. This is also made possible by the angled connecting member 132 of the support arm 108 that displaces the elongated member 130 (to which the spa cover is attached) from the axis of rotation about the pivot 122 when the spa cover is in the fully open position.

Figure 9:
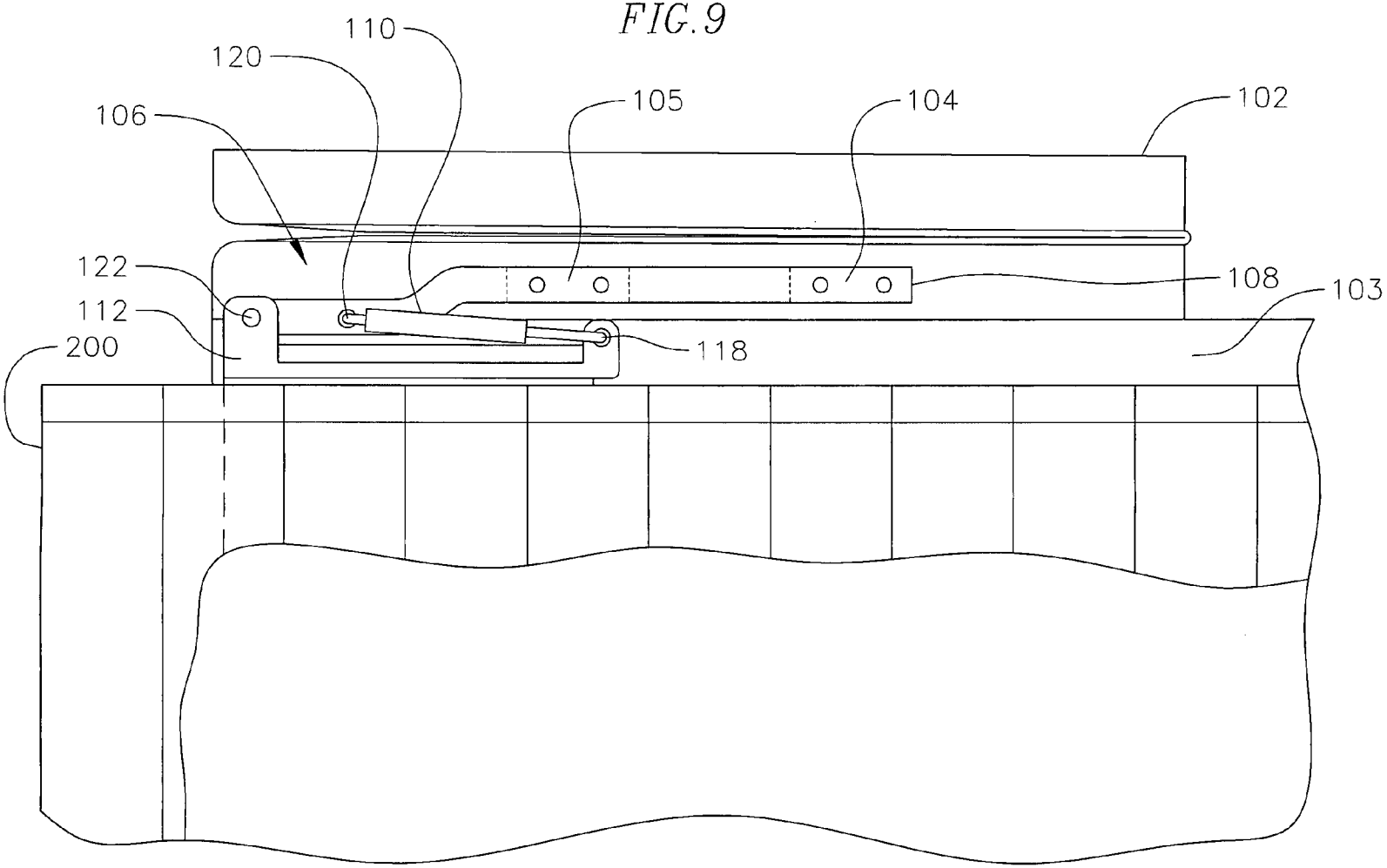
FIG. 9 is a side view of the hinge assembly, spa cover and spa of FIG. 1, in which the spa is enclosed in a deck.

FIG. 9 is a side view of the hinge assembly 106, the spa cover 102 and the spa 100 of FIG. 1, where the spa cover 102 is in a closed position. The spa 100 is enclosed in a deck 200 except for a small portion at the top (e.g., top of the inner spa 103). The deck 200 may be made of wood or any other suitable material. In other embodiments, the deck may only partially enclose the spa.

The operation of the hinge assembly 106 is substantially the same as that of the hinge assembly of FIGS. 1, 2 and 8. One difference is that the hinge assembly 106 is not mounted on the side mount support bracket 114 or the brace 116. Instead, the mounting bracket 112 is mounted directly on the deck 200, which provides support to the hinge assembly 106.

Figure 10:
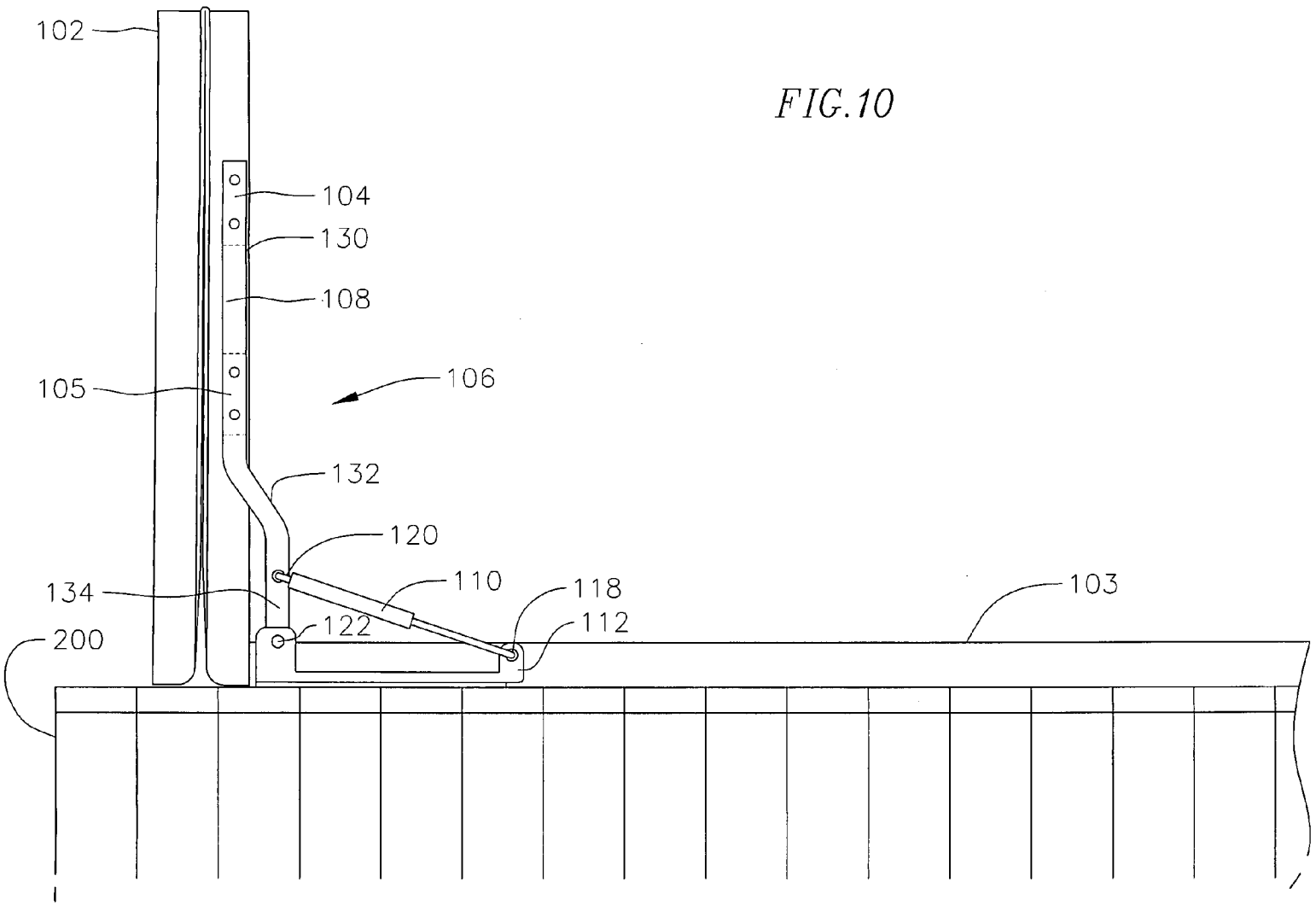
FIG. 10 is a side view of the hinge assembly (in an open position), spa cover, spa and deck of FIG. 9.

FIG. 10 is a side view of the hinge assembly 106, the spa cover 102 and the deck 200 of FIG. 9, where the spa cover 102 is in an open position. The operation of the hinge assembly 106 is substantially the same as that of the hinge assembly 106 of FIGS. 1, 2 and 8. It can be seen in FIG. 10 that the spring member 110, when the spa is fully open, forms an angle with respect to the top of the spa that is approximately 15 degrees. Such small angle between the spring member 110 and the top of the spa provides additional resistance against force, e.g., gust of wind, that tend to close the spa cover 102, as compared to the spring members that form an angle greater than approximately 45 degrees.

It can also be seen in FIG. 10 that the spa cover 102 rests at the top of the deck 200. This is possible at least partly due to the fact that the spa cover 102 is not connected directly to the pivot 122 and that the angled connecting member 132 allows the spa cover 102 to be slightly lifted up off the top of the spa 100 as the support arm 108 rotates about the pivot 122. In other words, the support arm 108 is shaped to enable the spa cover 102 to be lifted up from the top of the spa and not aligned with an axis of rotation as the support arm is pivotably rotated with respect to the mounting bracket 112 to place the spa cover in a fully open position, and to enable the spa cover 102 to rest directly on the deck 200.

It will be appreciated by those of ordinary skill in the art that the invention can be embodied in other specific forms without departing from the spirit or essential character thereof. The present invention is therefore considered in all respects to be illustrative and not restrictive. The scope of the invention is indicated by the appended claims, and all changes that come within the meaning and range of equivalents thereof are intended to be embraced therein.

The invention claimed is:

1. A hinge assembly for coupling a foldable spa cover to a spa, said spa cover having an upper section and a lower section that are coupled to each other at a hinge joint and being movable between a fully closed position and a fully open position, said hinge assembly comprising:

a mounting bracket adapted to be installed near a top of the spa;

a support arm which is pivotably coupled to the mounting bracket about an axis of rotation, and adapted to be attached on an outside surface of the lower section of the spa cover; and a gas spring disposed between the mounting bracket and the support arm, wherein the gas spring is adapted to be extended and inclined upward in a direction toward a rear end of the spa from an end coupled to the mounting bracket to another end coupled to the support arm as the spa cover is moved toward the fully open position and to form an angle of less than approximately 45 degrees with respect to the top of the spa when the spa cover is in the fully open position in which the spa cover forms an approximately 90 degree angle with respect to the top of the spa and a rear end of the spa cover is at or near the top of the spa, and be compressed as the spa cover is moved toward the fully closed position such that the gas spring is adapted to resist movement of the spa cover from the fully open position toward the fully closed position.

2. The hinge assembly of claim 1, wherein the gas spring is adapted to form an angle of between approximately 10 degrees and approximately 20 degrees with respect to the top of the spa when the spa cover is in the fully open position.

3. The hinge assembly of claim 1, wherein the support arm comprises:

an elongated member attached along a side of the spa cover;

a short member, which is pivotably coupled to the mounting bracket; and a connecting member that forms an angle with respect to both the elongated member and the short member.

4. The hinge assembly of claim 3, wherein the spring member is connected to the short member.

5. The hinge assembly of claim 1, wherein the support arm comprises:

an elongated member adapted to be attached along a side of the spa cover;

a short member, which is pivotably coupled to the mounting bracket; and a connecting member between the elongated member and the short member, said connecting member having a curvature.

6. The hinge assembly of claim 1, wherein the mounting bracket is mounted on a support bracket, which is adapted to be attached to a side of the spa.

7. The hinge assembly of claim 1, wherein the mounting bracket is mounted on a deck adjacent to the spa.

8. The hinge assembly of claim 1, wherein an attachment location between the gas spring and the support arm can be adjusted.

9. The hinge assembly of claim 1, wherein the support arm is adapted to be attached to the spa cover via a metal plate adapted to be disposed on the outside surface of the spa cover.

10. The hinge assembly of claim 9, wherein the metal plate is adapted to be affixed to the spa cover via a double sided tape.

11. The hinge assembly of claim 10, wherein the metal plate has a hole formed thereon, wherein the hole is adapted such that a screw can be inserted through the hole into the spa cover, and wherein the screw is adapted to be anchored in the spa cover by rotating the screw.

12. The hinge assembly of claim 1, wherein the support arm is adapted to be fixedly attached to a side surface of the lower section of the spa cover at a location away from the hinge joint between the upper section and the lower section.

13. A hinge assembly for coupling a spa cover to a spa, said foldable spa cover having an upper section and a lower section that are coupled to each other at a hinge joint and being movable between a fully closed position and a fully open position, said hinge assembly comprising:

a mounting bracket adapted to be installed near a top of the spa;

a support arm which is pivotably coupled to the mounting bracket about an axis of rotation, and adapted to be attached on an outside surface of the lower section of the spa cover; and a gas spring disposed between the mounting bracket and the support arm, wherein the gas spring is adapted to be extended and inclined upward in a direction toward a rear end of the spa from an end coupled to the mounting bracket to another end coupled to the support arm as the spa cover is moved toward the fully open position and to form an angle of less than approximately 45 degrees with respect to the top of the spa when the spa cover is in the fully open position in which the spa cover forms an approximately 90 degree angle with respect to the top of the spa and a rear end of the spa cover is at or near the top of the spa, and be compressed as the spa cover is moved toward the fully closed position such that the gas spring is adapted to resist movement of the spa cover from the fully open position toward the fully closed position, wherein the support arm is adapted to be attached to the spa cover via a metal plate adapted to be disposed on the outside surface of the spa cover, wherein the metal plate is adapted to be affixed to the spa cover via a double sided tape, wherein the metal plate has a hole formed thereon, wherein the hole is adapted such that a screw can be inserted through the hole into the spa cover, and wherein the screw is adapted to be anchored in the spa cover by rotating the screw, and wherein a deformable anchor is engaged with the screw, and wherein the deformable anchor is adapted to be deformed and embedded inside the spa cover as the screw is rotated.

14. A spa system comprising:

a spa;

a foldable spa cover having at least two sections including an upper section and a lower section that are coupled to each other at a hinge joint, said spa cover being movable between a fully closed position and a fully open position;

a hinge assembly for coupling the spa cover to the spa, said hinge assembly comprising:

a mounting bracket disposed near a top of the spa;

a support arm which is pivotably coupled to the mounting bracket about an axis of rotation, and attached on an outside surface of the lower section of the spa cover; and a gas spring disposed between the mounting bracket and the support arm, wherein the gas spring is extended and inclined upward in a direction toward a rear end of the spa from an end coupled to the mounting bracket to another end coupled to the support arm as the spa cover is moved toward the fully open position and forms an angle of less than approximately 45 degrees with respect to the top of the spa when the spa cover is in the fully open position in which the spa cover forms an approximately 90 degree angle with respect to the top of the spa and a rear end of the spa cover is at or near the top of the spa, and is compressed as the spa cover is moved toward the fully closed position such that the gas spring resists movement of the spa cover from the fully open position toward the fully closed position.

15. The spa system of claim 14, further comprising a metal plate used to attach the support arm to the spa cover, wherein the spa cover comprises a core and a cover, and wherein the metal plate is mounted on the outside surface of the cover.

16. The spa system of claim 14, wherein the spa cover in the fully open position is in an upright position, in which the spa cover has not been moved downward behind the spa.

17. The spa system of claim 14, wherein the spa cover in the fully open position is completely removed from the top of the spa without moving downward.

18. The spa system of claim 14, wherein the support arm is fixedly attached to a side surface of the lower section of the spa cover at a location away from the hinge joint between the upper section and the lower section.

19. A method of mounting a hinge mechanism between a spa and a foldable spa cover having a core and a cover and having an upper section and a lower section that are coupled to each other at a hinge joint, the hinge mechanism comprising a gas spring, said method comprising:

orienting the gas spring such that it is extended and inclined upward in a direction toward a rear end of the spa from an end coupled to the mounting bracket to another end coupled to the support arm as the spa cover is moved from a fully closed position to a fully open position and forms an angle of 45 degrees or less with respect to a top of the spa when the spa cover is in the fully open position in which the spa cover forms an approximately 90 degree angle with respect to the top of the spa and a rear end of the spa cover is at or near the top of the spa, and is compressed as the spa cover is moved toward the fully closed position such that the gas spring resists movement of the spa cover from the fully open position toward the fully closed position;

affixing at least one metal plate on the core or an outside surface of the lower section of the spa cover at a location away from the hinge joint, said at least one metal plate having a hole; and inserting a screw and an anchor engaging the screw through the hole on said at least one metal plate into the spa cover.

20. The method of claim 19, further comprising:

rotating the screw such that the anchor engaging the screw moves toward a head of the screw, whereby the anchor is deformed as it is being embedded within the core.

21. The method of claim 19, wherein the cover is fabricated using vinyl and the core is fabricated using foam material.

22. The method of claim 19, further comprising attaching a support arm to the spa cover using said at least one metal plate, wherein the support arm is hingedly coupled to a mounting bracket.

23. The method of claim 19, further comprising mounting the mounting bracket on or near a peripheral edge at a top of the spa.

24. The method of claim 19, wherein the metal plate is affixed to the outside surface of the spa cover using an adhesive, and wherein the adhesive provides sealing to the cover.

25. The method of claim 24, wherein the adhesive comprises a double sided tape.

* * * * *